US005991974A

United States Patent [19]

Carpinella

[11] Patent Number: 5,991,974

[45] **Date of Patent: *Nov. 30, 1999**

[54] SWIVELING FURNITURE GLIDE

[75] Inventor: Ralph Carpinella, Middlebury, Conn.

[73] Assignee: Carpin Manufacturing, Inc., Waterbury, Conn.

[ * ] Notice: Under 35 U.S.C. 154(b), the term of this patent shall be extended for 495 days.

[21] Appl. No.: 08/900,476

[22] Filed: Jul. 25, 1997

[51] Int. Cl.[6] ..... A47B 91/06

[52] U.S. Cl. ..... 16/42 R; 16/30; 248/188.9

[58] Field of Search ..... 248/684, 688, 248/677, 188.1, 188.8, 188.9, 687, 523, 534, 538, 539, 314, 316.1, 316.2, 316.7, 501, 502; 16/42 R, 30; 29/525.06

[56] References Cited

U.S. PATENT DOCUMENTS

| | | | |
|---|---|---|---|
| 934,005 | 9/1909 | Neuberth | 16/30 |
| 1,341,133 | 5/1920 | Johnson | 16/42 R |
| 2,753,586 | 7/1956 | Metz | 16/30 X |
| 2,974,352 | 3/1961 | Lockwood | 16/42 R |
| 3,363,280 | 1/1968 | Le Vasseur | 16/42 R |
| 3,381,331 | 5/1968 | Reynolds | 16/42 R |
| 3,505,724 | 4/1970 | Leitner et al. | 16/42 R |

*Primary Examiner*—Ramon O. Ramirez
*Assistant Examiner*—Stephen S. Wentsler
*Attorney, Agent, or Firm*—Alix, Yale & Ristas, LLP

[57] ABSTRACT

A furniture glide has a clip having a pair of upstanding arms mounted within a circular ferrule. The ferrule defines a ferrule opening diameter less than the diameter of the clip arms. The clip is sufficiently resiliently deformable to be insertable through the ferrule opening and return to its original diameter. A rivet having concentric convex and concave swivel surface extends from the ferrule to support a shell assembly on the convex swivel surface. A glide base is mounted to the shell assembly and contacts the concave swivel surface.

14 Claims, 3 Drawing Sheets

SWIVELING FURNITURE GLIDE

FIELD OF THE INVENTION

This invention relates to the field of furniture glide components. More specifically, this invention relates to an improved swiveling furniture glide for the leg of an article of furniture and a method for manufacture of the same.

BACKGROUND OF THE INVENTION

Furniture glides are well known for fixation to the leg of an article of furniture to protect the end portion of the leg from damage, and further, to protect a floor surface from damage as a result of the furniture leg.

The conventional furniture glide typically employs a plastic bottom surface for contact with the floor to allow sliding of the furniture on a floor surface without excessive gouging or scratching of that floor surface. Furthermore, the conventional furniture glide spreads the mass of the furniture and any additional mass, for example, a person sitting in a chair, over a larger surface area to prevent denting or impression into the floor surface. Some furniture glides further employ a swiveling mechanism to allow the bottom of the glide to rest flat on a floor surface for varying angles of the furniture leg. The swiveling mechanism compensates for slight variations in the lengths of the legs of furniture, variations in the flatness of the floor surface, and splay in the legs of the article of furniture.

A conventional swiveling furniture glide requires at least three assembly operations for complete construction. In the first operation a tubular clip for gripping a furniture leg is inserted into a thin walled ferrule having a constant diameter. The top edge of the ferrule is then rolled or crimped to maintain the clip in position. In the second assembly operation a disc shaped support platform is mounted to the bottom of the ferrule. The support platform reinforces the ferrule and provides the structural support to hold the tubing of the leg. A rivet having on one end a rounded portion, and on the other end an expandable head, is inserted through aligned openings in the ferrule and support platform. The head of the rivet is expanded to fix the ferrule and support platform together. The rounded portion of the rivet supports a pair of nesting shells. In the final assembly operation a nylon base for contact with the floor, and a vinyl cushion, are installed by crimping the outer shell to the base whereby the cushion is between the rounded portion of the rivet and the base. The cushion absorbs the forces from changing weights on the furniture. The base allows the furniture to slide or glide along a floor surface.

SUMMARY OF THE INVENTION

Briefly stated, the furniture glide of the invention has a ferrule and a clip defining a base portion whereby when the ferrule and clip are assembled the base portion of the clip can be fixed to the ferrule. The ferrule comprises a base wall and a cylindrical upstanding side wall curving radially inward at the upper portion. The radially inward curving upper top portion of the side wall defines a ferrule opening. Positioned within the ferrule is the clip engageable to the outside surface of a furniture leg. The clip is insertable through the ferrule opening and preferably has a diameter greater than the ferrule opening. The ferrule and clip define aligned rivet openings and are held in engagement by the rivet extending through the rivet opening.

The rivet has an expandable head portion and a swivel portion that extends from the bottom of the ferrule. The swivel portion of the rivet preferably defines a concave swivel surface and a convex swivel surface concentric with the concave swivel surface. A shell assembly, having a pair of nesting swiveling shells, slidingly engages the outer convex swivel surface of the rivet. The shell assembly supports a nylon base for contact with a floor surface. The nylon base defines an annular outer edge portion fixed to the outer shell and a central post portion slidably engaged to the concave swivel surface of the rivet.

In the preferred form of the invention, the clip is formed from a longitudinal strip of metal. The clip has a central base portion defining a rivet opening. A pair of oppositely positioned clip arms extend upward toward the ferrule opening. The clip arms are spaced apart and define a width greater than the diameter of the ferrule opening. Each clip arm is preferably spaced apart from the ferrule wall and further defines an inwardly projecting prong for engagement to the side surface of a furniture leg.

The rivet is preferably cylindrical, having an expandable head portion and a swivel portion. The swivel portion has a concave swivel surface and a convex swivel surface. The convex and concave swivel surfaces are concentric spherical surfaces. The shell assembly having an annular outer shell and an annular inner shell is positioned in sliding engagement with the outer convex swivel surface of the rivet. The inner shell defines an inner shell opening. The portion of the inner shell adjacent the inner shell opening is in sliding swiveling contact with the convex swiveling surface of the rivet. The outer shell defines an outer shell opening smaller than the largest diameter of the inner shell. The portion of the outer shell adjacent the outer shell opening is in sliding swiveling contact with the outer surface with the inner shell.

The unitary glide base is mounted to the outer shell and is preferably formed of a hard plastic, such as nylon, for contact with a floor surface. The outer edge of the glide base is held in position on the outer shell by the rolled or crimped outer edge of the outer shell. The glide base further preferably defines a central upstanding post portion defining a spherical swiveling surface in congruent contact with the concave swiveling surface of the rivet. The height of the post portion is dimensioned to tightly maintain the inner and outer shells in contact with each other, and furthermore, the inner shell in contact with the convex swivel surface of the rivet.

The furniture glide in accordance with the invention allows for a simplified and more efficient method of manufacture. In the preferred form, the furniture glide of the invention comprises six components that can be assembled in two assembly operations.

In the first assembly operation, the clip is inserted through the ferrule opening whereby the clip collapses to a reduced diameter to pass through the ferrule opening. The clip springs back into generally its original configuration once fully seated in the ferrule. The rivet, supporting the shell assembly, is inserted through the aligned rivet openings in the ferrule and the clip. The head of the rivet is rounded over inside the ferrule to maintain the ferrule and clip in surface to surface contact. The first assembly operation forms the first subassembly of manufacture.

In the second assembly operation, the glide base is positioned within the shell assembly and in contact with the swivel portion of the rivet. The outer edge of the outer shell is crimped or rolled to maintain the glide base in position. The assembly of the furniture glide of the invention is therefore completed.

An object of the invention is to provide a furniture glide having an improved clip for engagement to a furniture leg.

Another object of the invention is to provide a furniture glide that is more efficient to assemble.

A further object of the invention is to provide a furniture glide that provides a reduced number of components.

These and other objects of the invention are readily apparent from review of the specification and drawings.

DETAILED DESCRIPTION OF THE INVENTION

Figure 1:
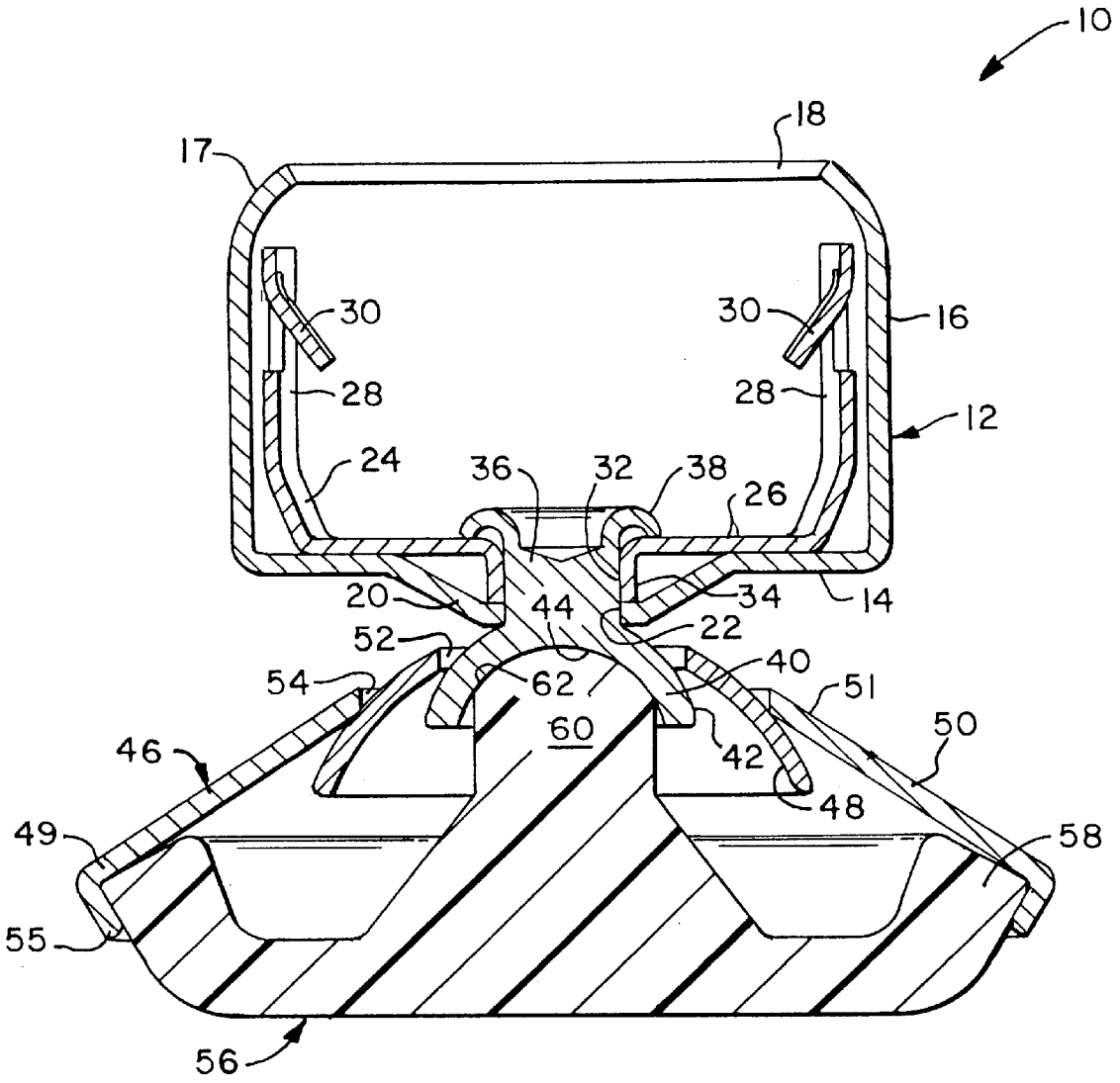
FIG. 1 is a lateral cross-sectional view of the furniture glide of the invention having a ferrule, a clip, a rivet, an inner shell, an outer shell, and a glide base.

In the following description of the preferred embodiments of the invention, like numeral identifiers represent like components as depicted in the figures. The furniture glide in accordance with the invention is generally designated by the numeral 10. With reference to FIG. 1, the furniture glide 10 has a ferrule 12. The ferrule 12 has a circular bottom wall 14 and an upstanding cylindrical side wall 16. The upper portion 17 of the side wall 16 preferably angles radially inward to define a circular ferrule opening 18. The ferrule opening 18 is preferably chosen to closely match the outer diameter of the furniture leg (not shown).

The diameter of the ferrule opening 18 is less than the diameter of the bottom wall 14. The bottom wall 14 defines a circular rivet opening 22 coaxial with the ferrule opening 18. The bottom wall 14 of the ferrule 12 is further preferably contoured having a dropped portion 20 adjacent the rivet opening 22.

Figure 4:
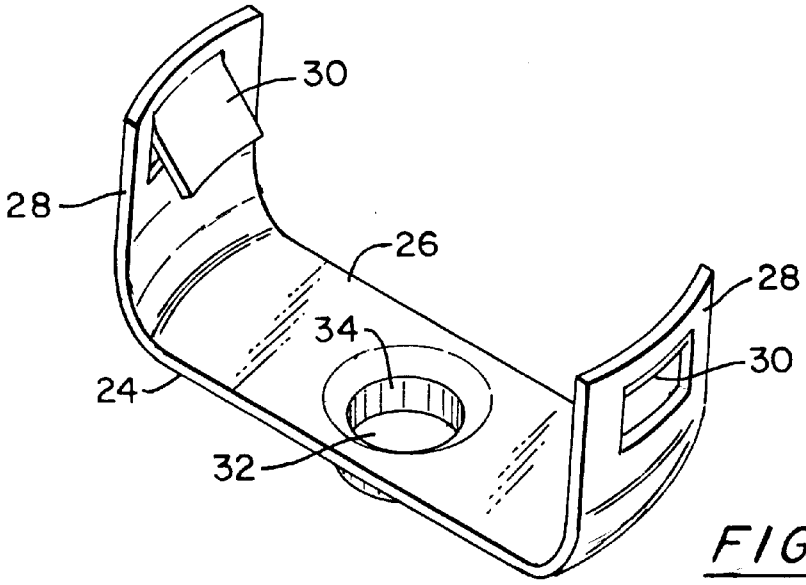
FIG. 4 is a perspective view of the clip of FIG. 1.

A clip 24 is positioned within the ferrule 12. The clip 24 is formed from a longitudinal resilient metal strip. (See FIGS. 1 and 4) The clip 24 has a clip base 26 which has a footprint smaller than the opening 18, and a pair of oppositely positioned clip arms 28. The clip arms 28 extend generally perpendicularly upward from the clip base 26.

The unstressed clip arms 28 define a neutral diameter greater than the diameter of the ferrule opening 18. The arms 28 and base 26 of the clip 24 are resiliently deformable whereby as the clip 24 is inserted base first into the ferrule opening 18, the clip arms 28 deform radially inwardly to the smaller diameter of the ferrule opening. The clip arms 28 return to generally the neutral shape after passage through the ferrule opening 18. Each clip arm 28 further includes a radially inwardly extending prong 30. The prongs 30 frictionally engage the outer surface of the furniture leg (not shown) to thereby mount the furniture glide 10 to the furniture leg.

The furniture leg is inserted through the ferrule opening 18 until fully seated against the clip base 26. As the furniture leg is forced between the arms 28 of the clip 24, the arms are forced radially outward to contact the side wall 16 of the ferrule 12. The prongs 30 are sufficiently resiliently deformable to be forced radially outwardly by the furniture leg and continue to maintain a radially inward force. The radial inward force of the prongs 30 provides a continuous frictional engagement of the prongs 30 to the outer surface of the furniture leg. The engagement of the prongs 30 to the outer surface thereby secures the furniture glide 10 on the furniture leg.

The clip base 26 defines a central clip rivet opening 32. The clip rivet opening 32 is aligned with the ferrule rivet opening 22 when the clip 24 is mounted in the ferrule 12. The clip base 26 further projects downward to form a cylindrical portion 34 having a length equivalent to the depth of the contour of the drop portion 20 of the ferrule 12. The rivet openings 22, 32 are of the same diameter.

Figure 2:
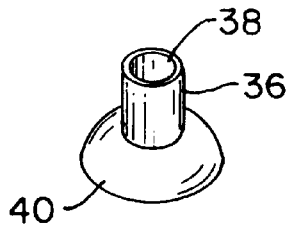
FIG. 2 is a perspective view of the rivet of FIG. 1.

A rivet 36 is secured through the clip and ferrule rivet openings 32, 22. The rivet 36 has an expandable head portion 38 and an opposite swivel portion 40. (See FIGS. 1 and 2) The head portion 38 of the rivet 36 is inserted through the aligned rivet openings 22, 32 and rounded or peened over to pull the swivel portion against the bottom wall 14 of the ferrule. The rivet 36 securely fastens the ferrule 12 and clip 24 together. The clip 24 and ferrule 12, when riveted together, are capable of fully supporting a furniture leg, and therefore preferably do not require any additional structural elements. Swivel portion 40 of the rivet 36 extends downward from the bottom wall 14 and radially outward to define a convex spherical outer swivel surface 42 and a concentric inner spherical swivel surface 44.

A shell assembly 46, having an inner shell 48 and an outer shell 50, slidably engages the outer swivel surface 42 of the rivet 36. The inner shell 48 is generally spherical and defines a circular inner shell opening 52 having a diameter less than the swivel portion 40 of the rivet 36. The inner shell 48 is nested within the outer shell 50. The outer shell 50 has a generally frustoconical shape forming an expanded portion 49 defining an outer edge 55 and a reduced portion 51. The outer shell 50 defines a circular outer shell opening 54 at the reduced portion 51 having a diameter less than the outer diameter of the inner shell 48. The spherical shape of the inner shell 48 allows for improved swiveling sliding engagement of the inner shell 48 with the outer shell 50.

Figure 3:
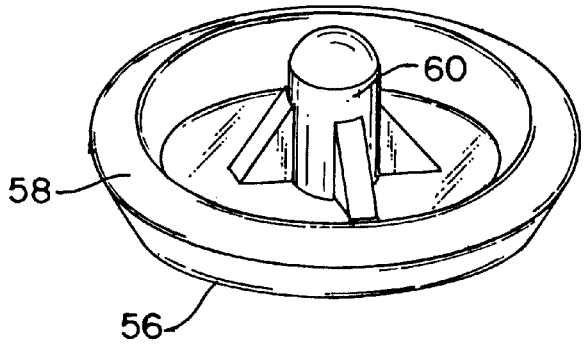
FIG. 3 is a perspective view of the glide base of FIG. 1.

A glide base 56 is mounted to the expanded portion 49 of the outer shell 50. The glide base 56 is preferably molded as a unitary or singular component. The base 56 is circular, having an annular rim portion 58 for engagement to the outer shell 50 and an axial elevated central post portion 60. (See FIGS. 1 and 3) The glide base 56 is mounted in position by the crimped outer edge 55 of the outer shell 50. The post portion 60 of the glide base 56 defines a generally convex base swivel surface 62 in congruent surface-to-surface contact with the inner swivel surface 44 of the rivet 36. The post portion 60 is dimensioned of a sufficient height to maintain the shell assembly 46 in tight engagement with the swivel portion 40 of the rivet 36. The swivel portion 40, inner shell 48, outer shell 50 and glide base 56 are preferably dimensioned to allow swiveling motion of the ferrule 12 relative to the base 56 of up to 32° from the vertical. Only the outer shell 50 would be required for furniture glides that require a smaller degree of swiveling. The glide base 56 is preferably constructed of a hard wear-resistant plastic such as nylon. The glide base 56 acts as a cushion and can slide or glide along a floor surface.

Figure 5:
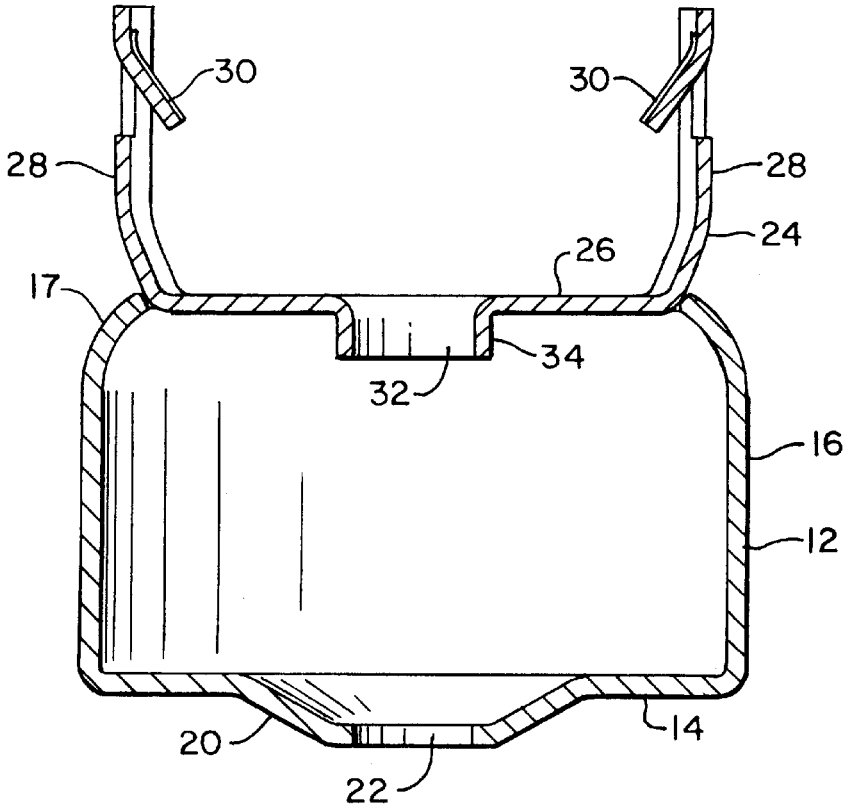
FIG. 5 is a lateral cross-sectional view of the clip and ferrule of FIG. 1 during the first assembly operation.
Figure 6:
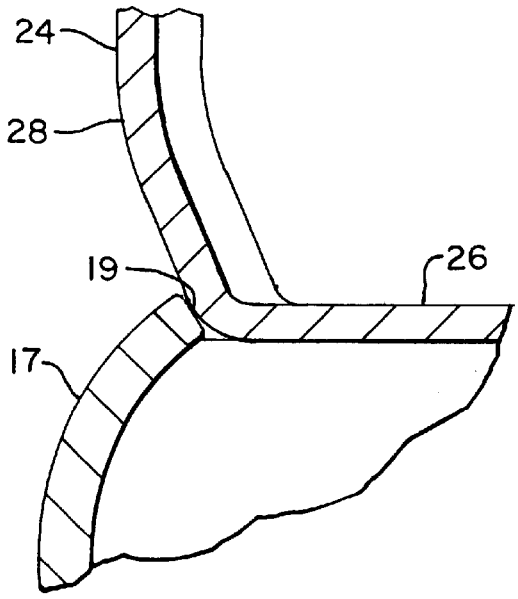
FIG. 6 is an enlarged detail view of the clip and ferrule interface of FIG. 5.

The furniture glide 10 can be manufactured by an improved method having a reduced number of manufacturing assembly operations. The furniture glide 10 of the invention can preferably be constructed in two manufacturing assembly operations. An assembly operation is when a component is permanently changed in shape by typically a machine or tool. In the first assembly operation, the clip 24 is forced through the ferrule opening 18 into the ferrule 12. The side wall 16 of the ferrule 12 defines an inward angled bevel 19 to aid in insertion of the clip 24 through the ferrule opening 18. (See FIGS. 4 and 5) The clip 24 resiliently deforms to pass through the ferrule opening 18. The clip 24 returns to its original shape once fully seated in the ferrule 12. Furthermore, during the first assembly operation, the head portion 38 of the rivet 36 is inserted through the ferrule rivet opening 22 and through the clip rivet opening 32. The rivet 16 supports the shell assembly 46 on the swivel portion 40. The head portion 38 of the rivet is then rounded or peened in the ferrule 12 to complete the first assembly operation.

In the second assembly operation, the glide base 56 is then positioned such that the base swivel surface 62 is engaged in the inner swivel surface 44 of the rivet 36. The outer edge 55 of the outer shell 50 is then crimped over to engage the rim portion 58 of the glide base 56, thereby mounting the glide base 56 to the subassembly to complete the furniture glide 10.

While a preferred embodiment of the present invention and method for manufacture of the same has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

I claim:

1. A furniture glide comprising:

a ferrule having a circular bottom wall and an upstanding cylindrical side wall having a radially inward curving top portion defining a circular ferrule opening having a ferrule opening diameter, said bottom wall defining a bottom wall diameter greater than said ferrule opening diameter;

a clip positioned in said ferrule having a clip base in contact with said bottom wall and a plurality of upstanding clip arms defining a clip diameter greater than said ferrule opening diameter, each clip arm having a radially inward extending prong engageable to a furniture leg, said clip resiliently deformable to be insertable through said ferrule opening, said clip having an engagement portion extending downwardly from said clip base;

a fastener for fastening said clip to said ferrule, said fastener having a shaft portion engaged with said engagement portion of said clip; and a glide base mounted to said ferrule.

2. The furniture glide of claim 1 wherein said plurality of upstanding clip arms comprises a pair of oppositely positioned clip arms.

3. The furniture glide of claim 1 wherein said fastener comprises a rivet fixing said clip to said ferrule.

4. The furniture glide of claim 3 wherein said rivet has a swivel portion, and said glide base is swivelably mounted to said swivel portion.

5. The furniture glide of claim 4 further comprising a shell assembly swivelable on said swivel portion and said shell assembly further mounts said glide base to said swivel portion.

6. The furniture glide of claim 4 wherein said swivel portion defines a spherical swivel surface.

7. The furniture glide of claim 4 wherein said swivel portion defines a concave swivel surface and a convex swivel surface.

8. The furniture glide of claim 7 wherein said concave and convex swivel surfaces are concentric.

9. A furniture glide comprising:

a ferrule having a bottom wall defining a ferrule rivet opening and a circular upstanding side wall extending from said bottom wall to define a ferrule opening and a ferrule diameter;

a clip for engagement to a furniture leg positioned within said ferrule comprising a base portion defining a clip rivet opening aligned with said ferrule rivet opening and a plurality of upstanding arms, said base portion defining a base width less than said ferrule diameter and said arms defining an arm width greater than said ferrule diameter, said clip resiliently deformable to be capable of passing through said ferrule opening;

a shell assembly comprising an outer shell defining an outer shell opening and an inner shell positioned partially through said outer shell opening, said inner and outer shells swivelable in relative relationship and said inner shell defining a first shell opening;

a glide base mounted to said shell assembly for contacting a floor; and a rivet having an expanded head portion and a swivel portion extending through said ferrule rivet opening, said clip rivet opening and said first shell opening for holding said ferrule, clip means and shell assembly together wherein said clip and said ferrule are in fixed engagement and said shell assembly is swivelable on said rivet relative to said ferrule.

10. The furniture glide of claim 9 wherein said rivet defines a convex swivel surface and said shell assembly is swivelable on said convex swivel surface.

11. The furniture glide of claim 10 wherein said rivet means defines a concave swivel surface and said glide base defines a congruent base swivel surface swivelable on said concave swivel surface.

12. A furniture glide for engaging a furniture leg comprising:

a ferrule having a circular opening defining a ferrule opening diameter for receiving said leg and said ferrule defining a ferrule rivet opening;

clip means positioned in said ferrule comprising a base portion and a plurality of arms extending from said base portion, said plurality of arms being spaced in opposition to receive said leg, each arm having a prong which opposes another prong on another arm at a distance less than the ferrule opening diameter, said base portion defining a base rivet opening;

a glide base for contacting a floor, said glide base defining a convex swivel surface; and mounting means attaching said glide base to said ferrule comprising a rivet extending through said ferrule rivet opening and said base rivet opening to mount said clip to said ferrule, said rivet defining a concave swivel surface;

wherein said convex swivel surface of said glide base is in surface to surface contact with said concave swivel surface of said rivet.

13. The furniture glide of claim 12 wherein said concave and convex swivel surfaces are spherical and have the same center of curvature.

14. A furniture glide for engaging a furniture leg comprising:

a ferrule having a circular opening defining a ferrule opening diameter for receiving said leg and said ferrule defining a ferrule rivet opening;

clip means positioned in said ferrule comprising a base portion and a plurality of arms extending from said base portion, said plurality of arms being spaced in opposition to receive said leg, each arm having a prong which opposes another prong on another arm at a distance less than the ferrule opening diameter, said clip means defining a clip rivet opening aligned with said ferrule rivet opening;

a glide base for contacting a floor, said glide base defining a convex surface;

mounting means comprising a rivet extending through said ferrule rivet opening and said clip rivet opening for mounting said clip to said ferrule, said rivet defining concentric convex and concave swivel surfaces; and a shell assembly mounting said glide base to said rivet, said shell assembly defining a concave surface;

wherein said concave surface of said shell assembly and said convex surface of said glide base are in swivelable contact with said convex and concave swivel surfaces of said rivet, respectively.

* * * * *